US012624404B2

(12) United States Patent
Kobashi et al.

(10) Patent No.: US 12,624,404 B2
(45) Date of Patent: May 12, 2026

(54) METHOD FOR OPERATING BLAST FURNACE

(71) Applicant: JFE STEEL CORPORATION, Tokyo (JP)

(72) Inventors: Yoshifumi Kobashi, Tokyo (JP); Naoshi Yamahira, Tokyo (JP); Toshiki Tsuboi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 760 days.

(21) Appl. No.: 17/771,971

(22) PCT Filed: Oct. 19, 2020

(86) PCT No.: PCT/JP2020/039288
§ 371 (c)(1),
(2) Date: Apr. 26, 2022

(87) PCT Pub. No.: WO2021/085221
PCT Pub. Date: May 6, 2021

(65) Prior Publication Data

US 2022/0380859 A1 Dec. 1, 2022

(30) Foreign Application Priority Data

Oct. 31, 2019 (JP) ..... 2019-198507

(51) Int. Cl.
*C21B 7/00* (2006.01)
*C21B 5/00* (2006.01)
*C21B 7/16* (2006.01)

(52) U.S. Cl.
CPC ..... *C21B 7/007* (2013.01); *C21B 5/003* (2013.01); *C21B 5/007* (2013.01); *C21B 5/008* (2013.01); *C21B 7/16* (2013.01)

(58) Field of Classification Search
CPC ..... C21B 7/007; C21B 5/003; C21B 5/007; C21B 5/008; C21B 7/16; C21B 2300/04;
(Continued)

(56) References Cited

U.S. PATENT DOCUMENTS 4,197,495 A * 4/1980 Matsui ..... C21B 7/24 324/207.22

FOREIGN PATENT DOCUMENTS

CN 109487022 A 3/2019
EP 3 561 082 A1 10/2019
(Continued)

OTHER PUBLICATIONS

Chung, Jin Kyung, Seung Moon Lee, and Min Soo Shin. "Effect of coke size on reducing agent ratio (RAR) in blast furnace." ISIJ International 58.12 (2018): 2228-2235. (Year: 2018).*
(Continued)

*Primary Examiner* — Keith D. Hendricks
*Assistant Examiner* — Moriah S. Smoot
(74) *Attorney, Agent, or Firm* — OLIFF PLC.

(57) ABSTRACT

A method for operating a blast furnace with which, even in the case where there is an increase in the powder ratio of coke to be charged into the blast furnace, it is possible to achieve the stabilization of blast furnace operation. The method includes blowing air through a tuyere disposed in a lower part of the blast furnace, successively measuring a particle size distribution of coke transported to the blast furnace, and adjusting at least one of a blast volume and a coke ratio in accordance with an index derived from the particle size distribution.

2 Claims, 4 Drawing Sheets

(58) Field of Classification Search
CPC . C21B 7/24; C21B 5/00; G01N 15/08; G01N 2015/1493; G01N 15/0227; G01N 15/1429; G01N 15/1433; G01N 15/1459
See application file for complete search history.

(56) References Cited

FOREIGN PATENT DOCUMENTS

| | | | | | |
|---|---|---|---|---|---|
| EP | 3 712 281 | A1 | | 9/2020 | |
| JP | S53-117623 | A | | 10/1978 | |
| JP | S62-083410 | A | | 4/1987 | |
| JP | H08-199210 | A | | 8/1996 | |
| JP | H09-078111 | A | | 3/1997 | |
| JP | H0978111 | A | * | 3/1997 | |
| JP | 2000008105 | A | * | 1/2000 | |
| JP | 2007-204791 | A | | 8/2007 | |
| JP | 2015-189988 | A | | 11/2015 | |
| JP | 2015-196888 | A | | 11/2015 | |
| JP | 6344001 | B2 | * | 6/2018 | |
| JP | 2018-123426 | A | | 8/2018 | |
| KR | 20180112829 | A | | 10/2018 | |
| KR | 10-2019-0054794 | A | | 5/2019 | |
| TW | 201209618 | A | | 3/2012 | |
| WO | WO-2017159641 | A1 | * | 9/2017 | ..... C21B 7/24 |
| WO | 2018/101287 | A1 | | 6/2018 | |
| WO | WO-2018117605 | A1 | * | 6/2018 | ..... C21B 13/0073 |
| WO | 2018/181942 | A1 | | 10/2018 | |

OTHER PUBLICATIONS

JP-6344001-B2 Trans (English Language Translation) (Year: 2018).*
WO-2017159641-A1 Trans (English Language Translation) (Year: 2017).*
Aug. 24, 2022 Office Action issued in Russian Patent Application No. 2022112803.
Cast Iron Metallurgy, Higher education textbook, 3rd edition, edited by Yu.S. Yusfin, Moscow, PBC "Akademkniga", pp. 367-409, 2004.
Jun. 16, 2021 Office Action issued in Taiwanese Patent Application No. 109137528.
Jan. 18, 2022 Office Action issued in Japanese Patent Application No. 2021-522106.
May 11, 2023 Office Action issued in Chinese Patent Application No. 202080074524.9.
Dec. 15, 2022 Office Action issued in Chinese Patent Application No. 202080074524.9.
Oct. 13, 2022 Extended European Search Report issued in European Patent Application No. 20882125.6.
Jan. 25, 2024 Office Action issued in Korean Patent Application No. 2022-7013373.
Jul. 29, 2023 Office Action issued in Chinese Patent Application No. 202080074524.9.
Nov. 24, 2020 International Search Report issued in International Application No. PCT/JP2020/039288.

* cited by examiner

METHOD FOR OPERATING BLAST FURNACE

TECHNICAL FIELD

This application relates to a method for operating a blast furnace in which a blast volume blown through a tuyere in a lower part of the furnace is controlled in accordance with a variation in the powder ratio of coke to be charged into the blast furnace.

BACKGROUND

In a blast furnace, pig iron is manufactured by alternately charging an iron oxide-based iron raw material and coke from the furnace top, by burning the coke with hot air blown through a tuyere in the lower part of the furnace to generate CO, and by reducing the iron oxides contained in sintered ore and lump ore with a reducing gas containing the generated CO.

In such a blast furnace operation, gas permeability in the blast furnace has a significant effect on stable blast furnace operation. To maintain satisfactory gas permeability in a blast furnace, maintaining satisfactory voids formed between coke particles is important. In the case where small lumps and powder are contained in the raw material, since the voids are filled with such small lumps and powder, there is a deterioration in gas permeability in the furnace, which results in unstable blast furnace operation. Therefore, generally, raw materials to be charged into a blast furnace are sieved to control the particle size of coke to be 25 mm to 35 mm or more and the particle size of sintered ore and iron ore to be 5 mm to 25 mm or more before being charged into the blast furnace. However, in the case of a common sieving method, it is difficult to completely remove powder adhering to coke. Powder adhering to coke is separated from the coke in the furnace, which results in a deterioration in gas permeability in the furnace. Therefore, in the case where it is possible to timely assess the amount of powder charged into a blast furnace, it is possible to operate the blast furnace in accordance with the assessed amount of powder.

Patent Literature 1 and Patent Literature 2 disclose powder fraction-measuring devices with which it is possible to measure the powder ratio adhering to coke transported on a conveyer. In the case of the powder fraction-measuring devices disclosed in Patent Literature 1 and Patent Literature 2, by conducting an advance survey on the relationship between the powder ratio adhering to lump coke and an average luminance in image data obtained by taking an image of lump coke, the powder ratio adhering to lump coke is determined online on the basis of an average luminance in image data obtained by taking the image of the lump coke transported on a conveyer to a blast furnace.

Patent Literature 3 discloses a powder ratio estimating method in which the powder fraction of a raw material for a blast furnace is estimated on the basis of the slope angle of a piled raw material in the furnace top bunker of a blast furnace. In the case of the powder fraction estimating method disclosed in Patent Literature 3, the powder fraction of a raw material for a blast furnace is estimated on the basis of the slope angle of a piled raw material in the furnace top bunker and the correlation between the slope angle of a piled raw material and the powder fraction.

CITATION LIST

Patent Literature

PTL 1: International Publication No. WO2018/101287
PTL 2: International Publication No. WO2018/181942

PTL 3: Japanese Unexamined Patent Application Publication No. 2015-196888

Non Patent Literature

NPL 1: Yamada, et al., "Distribution of Burden Materials and Gas Permeability in a Large Volume Blast Furnace", KAWASAKI STEEL GIHO Vol. 6 (1974) No. 1, pp. 16-37

SUMMARY

Technical Problem

Patent Literature 1 discloses only a powder fraction-measuring device and a powder fraction-measuring system with which it is possible to measure the powder fraction of lump coke to be charged into a blast furnace, and there is no mention of a specific method for operating a blast furnace on the basis of the measured powder fraction. Although Patent Literature 2 discloses a device for measuring the void fraction in a blast furnace on the basis of a powder fraction, there is no mention of a method for operating a blast furnace.

Patent Literature 3 discloses a method for operating a blast furnace on the basis of a fixed threshold value for the powder fraction of a raw material for a blast furnace which is estimated on the basis of the slope angle of a piled raw material in the furnace top bunker of the blast furnace. However, in the case of control on the basis of the fixed threshold value, it is not possible to prevent a deterioration in the operation state of the blast furnace caused by a variation in powder fraction. An object of the disclosed embodiments is to provide a method for operating a blast furnace with which, even in the case where there is a variation in the particle size distribution of coke to be charged into the blast furnace, it is possible to realize the stabilization of blast furnace operation by measuring the particle size distribution and by adjusting at least one of a blast volume blown through a tuyere and a coke ratio on the basis of an index derived from the measured particle size distribution.

Solution to Problem

The measures to solve the problems described above is as follows.

(1) A method for operating a blast furnace by blowing air through a tuyere disposed in a lower part of the blast furnace, the method including successively measuring a particle size distribution of coke transported to the blast furnace and adjusting at least one of a blast volume and a coke ratio in accordance with an index derived from the particle size distribution.

(2) The method for operating a blast furnace according to item (1), in which the blast volume is adjusted, in which a first threshold value for a variation in the index within a certain length of time is set in advance, in which, in a case where the first threshold value is positive, the blast volume is decreased when a variation in the index within a certain length of time is equal to or more than the preset first threshold value, and in which, in a case where the first threshold value is negative, the blast volume is decreased when a variation in the index within a certain length of time is equal to or less than the preset first threshold value.

(3) The method for operating a blast furnace according to item (1), in which the coke ratio is adjusted, in which a second threshold value for a variation in the index within a certain length of time is set in advance, in which, in a case where the second threshold value is positive, the coke ratio is increased when a variation in the index within a certain length of time is equal to or more than the preset second threshold value, and in which, in a case where the second threshold value is negative, the coke ratio is increased when a variation in the index within a certain length of time is equal to or less than the preset second threshold value.

(4) The method for operating a blast furnace according to item (1), in which a first threshold value for a variation in the index within a certain length of time and a second threshold value whose absolute value is more than an absolute value of the first threshold value are set in advance, in which, in a case where the first threshold value and the second threshold value are positive, the blast volume is decreased when a variation in the index within a certain length of time is equal to or more than the first threshold value and less than the second threshold value and the coke ratio is increased when a variation in the index within a certain length of time is equal to or more than the second threshold value, and in which, in a case where the first threshold value and the second threshold value are negative, the blast volume is decreased when a variation in the index within a certain length of time is equal to or less than the first threshold value and more than the second threshold value and the coke ratio is increased when a variation in the index within a certain length of time is equal to or less than the second threshold value.

(5) The method for operating a blast furnace according to any one of items (1) to (4), in which the index is a powder ratio of coke having a particle diameter of 5 mm or less included in the coke.

(6) The method for operating a blast furnace according to any one of items (1) to (4), in which the index is a void fraction of a coke-packed layer.

Advantageous Effects

As a result of implementing the method for operating a blast furnace according to the disclosed embodiments, even in the case where there is a variation in the particle size distribution of coke to be charged into the blast furnace, since it is possible to decrease the degree of gas flow turbulence in the furnace by adjusting at least one of a blast volume blown through a tuyere and a coke ratio in accordance with an index derived from a particle size distribution, it is possible to inhibit a pressure balance in the furnace from being significantly lost. By inhibiting a pressure balance in the furnace from being significantly lost in such a manner, it is possible to realize the stabilization of blast furnace operation.

DETAILED DESCRIPTION

Figure 1:
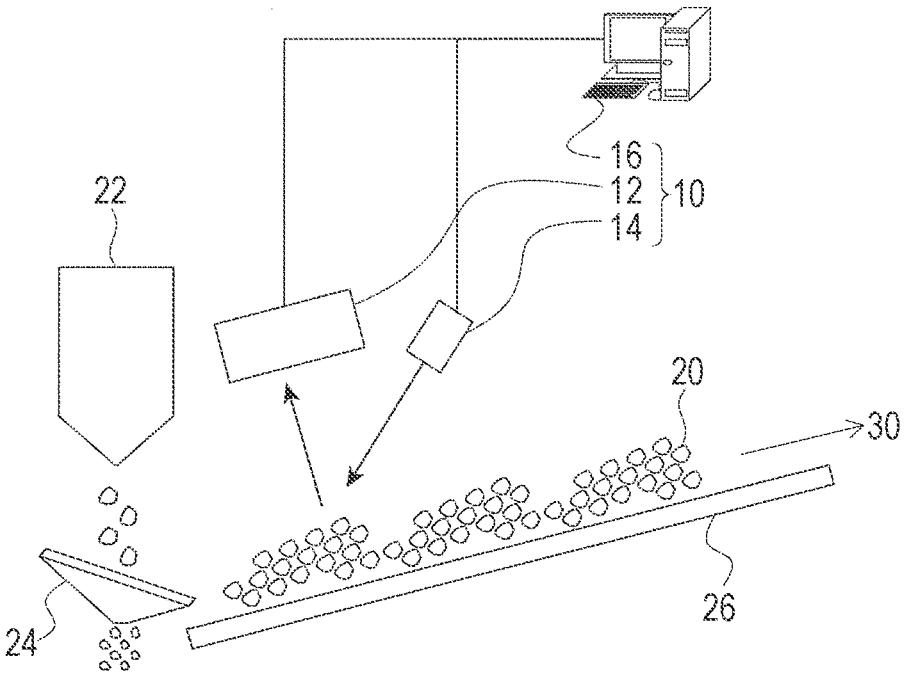
FIG. 1 is a schematic diagram illustrating one example of a particle size distribution measuring apparatus 10 with its peripheral components.

Hereafter, the disclosed embodiments will be described. In the method for operating a blast furnace according to the present embodiment, the particle size distribution of coke to be charged into the blast furnace is successively measured online. FIG. 1 is a schematic diagram illustrating one example of a particle size distribution measuring apparatus 10 with its peripheral components. Although a particle size distribution measuring apparatus 10 is described with reference to FIG. 1, not only the particle size distribution measuring apparatus 10 illustrated in FIG. 1 but also other measuring apparatuses may be used as long as it is possible to successively measure a particle size distribution online.

The particle size distribution measuring apparatus 10 has an image-taking device 12, an illuminating device 14, and a computing device 16. Coke 20 to be charged into a blast furnace is retained in a hopper 22. After the coke 20, which has been discharged from the hopper 22, has been sieved by using a sieve 24 so that powder having a particle diameter smaller than the sieve mesh of the sieve 24 passes through the sieve, the coke remaining on the sieve is transported to the blast furnace 30 by using a conveyer 26. In the present embodiment, the sieve mesh of the sieve 24 is 35 mm. Therefore, the coke 20, which is transported by using a conveyer 26, includes lump coke having a particle diameter of 35 mm or more and coke powder adhering to the lump coke which does not pass through the sieve 24. When the particle diameter of the coke powder adhering to the lump coke was measured, it was clarified that the coke powder had a particle diameter of 5 mm or less. In the present embodiment, the expression "coke powder having a particle diameter of 5 mm or less" denotes coke powder passing through a sieve having a sieve mesh of 5 mm.

The image-taking device 12 is disposed above the conveyer 26 so as to take an image of the coke 20 transported by using the conveyer 26 to produce image data. Examples of the image-taking device 12 include a digital camera having CCD-type or CMOS-type image taking sensors and lenses. Although it is preferable that the height of the position at which the image-taking device 12 is disposed be 500 mm or more and 1000 mm or less above the conveyer 26, the height at which the image-taking device 12 is disposed may be adjusted to take an image of the entire width of the coke being transported in accordance with the size of the image taking sensors and the angle of view of the lenses belonging to the image-taking device 12.

The image-taking device 12 produces image data by receiving light including light reflected by the surface of the coke 20 with image taking sensors. Coke powder adhering to the surface of the coke 20 has an effect on the light reflected by the surface of the coke 20. Therefore, the image data produced by receiving the light including light reflected by the surface of the coke 20 include information of the coke powder adhering to the surface of the coke 20.

The image data produced by the image-taking device 12 are output to the computing device 16 having a calculation unit and a conversion unit (not illustrated). The computing device 16 processes the image data output from the image-taking device 12. As described above, since the image data include information of the coke powder adhering to the surface of the coke 20, the calculation unit of the computing device 16 calculates a feature including information of the coke powder from the image data. Examples of the feature calculated by the calculation unit include an average luminance, which is the arithmetic average value of luminance (0 to 255) of each of the picture elements in the image data.

Figure 2:
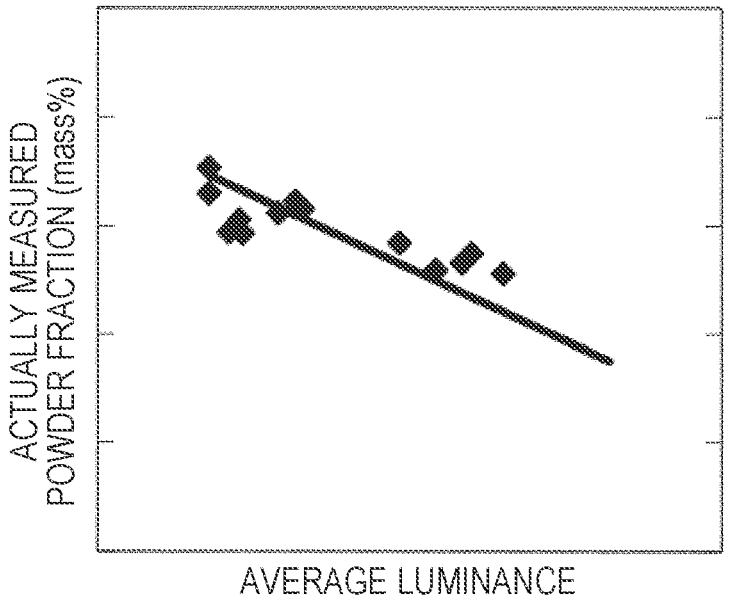
FIG. 2 is a graph illustrating the relationship between the average luminance and powder fraction of lump coke having a particle diameter of 35 mm or more to which coke powder adheres.

FIG. 2 is a graph illustrating the relationship between the average luminance and the powder fraction of lump coke having a particle diameter of 35 mm or more to which coke powder adheres. In FIG. 2, the vertical axis represents the actually measured fraction (mass %) of coke powder adhering to lump coke. The horizontal axis represents the average luminance in the image data obtained by taking the image of lump coke to which coke powder adheres. The lump coke having a particle diameter of 35 mm or more was prepared by sieving coke with a sieve having a sieve mesh of 35 mm. Regarding the powder ratio of coke adhering to the surface of lump coke, after lump coke had been dried at a temperature of 120° C. to 200° C. for 4 hours or more until reaching a constant mass, the dried coke was sieved by using a sieve having a sieve mesh of 5 mm, and the powder ratio of coke was defined as the ratio of a difference in the mass of the lump coke between before and after sieving to the mass thereof before sieving. This method is based on a phenomenon in which adhering powder is separated in the dried state. The average luminance in the image data of lump coke to which coke powder adheres was determined by calculating the arithmetic average value of the luminance (0 to 255) of each of the picture elements in the image data obtained by taking the image of the lump coke with a digital camera under predetermined illumination.

As illustrated in FIG. 2, the powder ratio of coke adhering to lump coke and the average luminance in the image data of lump coke correlated strongly with each other, and the contribution ratio ($R^2$), which indicates the degree of correlation, was 0.67. That is, it was clarified that the powder ratio of coke adhering to lump coke and the average luminance in the image data of lump coke correlate strongly with each other.

The average luminance calculated by the calculation unit is converted into the fraction of adhering powder by the conversion unit. In the conversion unit, a regression equation, which indicates the correlation between the powder ratio of coke adhering to the surface of coke and the average luminance illustrated in FIG. 2, is stored in advance, and the conversion unit converts the average luminance calculated by the calculation unit into the powder ratio of coke adhering to the surface of the coke 20 by using such a regression equation.

The image-taking device 12 retakes an image of the coke 20 to produce image data after a predetermined length of time has lapsed. The predetermined length of time may be determined in accordance with, for example, an image taking range, in which the image-taking device 12 can take an image of the coke 20, and the transporting speed of the conveyer 26. That is, the predetermined length of time may be defined as the time calculated by dividing the length in the transporting direction of the conveyer 26 of the image taking range by the transporting speed of the conveyer 26. Consequently, the image-taking device 12 can take seamless images of the coke 20 in the transporting direction of the conveyer 26. It is preferable that the image-taking device 12 take the image of the coke 20 in a direction perpendicular to the transporting direction of the conveyer 26.

The image data produced by the image-taking device 12 are output again to the computing device 16, and the computing device 16 calculates the powder ratio of coke adhering to the coke 20. By repeating the processing described above, the particle size distribution measuring apparatus 10 according to the present embodiment can measure online the powder ratio of coke adhering to the surface of the coke 20 transported by using the conveyer 26, that is, the powder ratio of coke having a particle diameter of 5 mm or less (hereinafter, also referred to as "powder ratio of coke"), and assess the powder ratio of coke having a particle diameter of 5 mm or less to be charged into the blast furnace 30 as a result of such measurement. The expression "the powder ratio of coke having a particle diameter of 5 mm or less" denotes the ratio of the mass of coke powder having a particle diameter of 5 mm or less to the total mass of coke, and it may be said that the expression denotes the particle size distribution of coke consisting of a particle size corresponding to a particle diameter of 5 mm or less and a particle size corresponding to a particle diameter of more than 5 mm. That is, the powder ratio of coke having a particle diameter of 5 mm or less according to the present embodiment is one example of an index derived from the particle size distribution of coke.

In the blast furnace 30, pig iron is manufactured by alternately charging the coke 20 and an iron raw material, such as sintered ore, from the furnace top, by burning the coke 20 with hot air blown through a tuyere in the lower part of the furnace to generate CO, and by reducing the iron oxides with a reducing gas containing the generated CO. To maintain stable operation of the blast furnace 30, maintaining satisfactory gas permeability in the blast furnace and thereby stabilizing the flow of a high-temperature gas blown through a tuyere in the lower part of the furnace is important. However, in the case where there is an increase in the powder fraction of the coke 20 to be charged into the blast furnace 30, since coke powder enters voids between coke particles, there is a decrease in void fraction, which results in a deterioration in furnace gas permeability. In the case where there is a deterioration in furnace gas permeability, since gas flow turbulence occurs in the furnace, the pressure balance in the furnace is lost, which results in unstable blast furnace operation.

Figure 3:
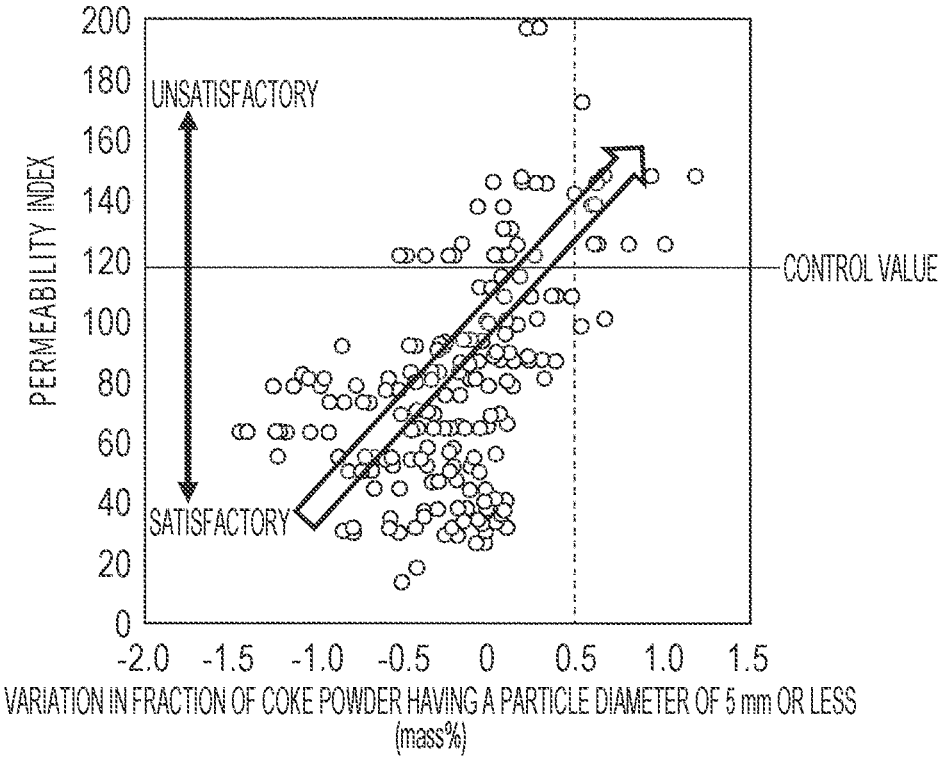
FIG. 3 is a graph illustrating the relationship between a variation in the powder ratio of coke within 4 hours and a permeability index.

FIG. 3 is a graph illustrating the relationship between a variation in the powder ratio of coke within 4 hours and a permeability index. In FIG. 3, the horizontal axis represents a variation in the fraction (mass %) of coke powder having a particle diameter of 5 mm or less within 4 hours, and, for example, the number "−0.5" on the horizontal axis denotes a case where there is a decrease in the powder ratio of coke by 0.5 mass % within 4 hours. That is, a variation in powder fraction represented by the horizontal axis is a value calculated by subtracting the powder ratio of coke 4 hours earlier from the powder ratio of coke at this point of time. The expression "powder ratio of coke at this point of time" denotes a value derived by successively measuring the powder ratio of coke each time coke is charged into a blast furnace in the hour immediately before this point of time, by calculating an average value of the powder fraction of every charge, and by calculating an average value of the calculated average values of the powder fraction. For example, in the case where coke is charged into a blast furnace 4 times in 1 hour, the powder ratio of coke at this point of time may be defined as the average value of the powder ratio of coke of the past four charges or the moving average value of the past charges. A variation in powder fraction represented by the horizontal axis is obtained by performing such a calculation every 1 hour and by subtracting the powder ratio of coke at a time 4 hours before this point of time from the powder ratio of coke at this point of time.

In FIG. 3, the vertical axis represents the permeability index at this point of time, and in the case where there is an increase in this permeability index, there is an increased variation in furnace gas permeability in the circumferential direction. The term "permeability index" denotes an index for evaluating the degree of gas flow turbulence in the blast furnace on the basis of a variation in temperature in the circumferential direction of the blast furnace, and, in the case of the example illustrated in FIG. 3, the index is defined as the standard deviation of gas temperature in the peripheral zone of the blast furnace which is measured by using seven thermometers arranged at a regular interval in the circumferential direction of the blast furnace at a level about 5 m lower than the stock line of the blast furnace. A permeability index of 120 is a value which is used as a control value for gas permeability in blast furnace operation, and, in the case where the permeability index is more than 120, since the pressure balance in the furnace is lost, there is unstable blast furnace operation. Therefore, it is necessary that the permeability index be controlled to be 120 or less.

Each of the plotted data in FIG. 3 is a permeability index for 4 hours from the point of time at which the permeability index was 120 or less, as a blast furnace had been operated without a change in conditions. As illustrated in FIG. 3, in the case where there is an increase in the powder ratio of coke by 0.5 mass % or more within 4 hours, there is an increase in the probability of the permeability index being more than 120. Therefore, in the method for operating a blast furnace according to the present embodiment, in the case where there is an increase in the hourly average value of the powder ratio of coke charged into a blast furnace by 0.5 mass % or more within 4 hours, for example, the blast volume of hot air blown through a tuyere is decreased by 5% or more. Consequently, even in the case where there is a deterioration in furnace gas permeability due to an increase in the amount of coke powder having a particle diameter of 5 mm or less, since it is possible to decrease the degree of gas flow turbulence in the furnace by decreasing the blast volume blown through the tuyere, it is possible to inhibit the pressure balance in the furnace from being significantly lost.

Since there is a case where the powder ratio of coke is always more than a threshold value depending on the raw material to be charged into the blast furnace, it is necessary that the threshold value be adjusted in accordance with the state of the raw material to be charged into the blast furnace. Therefore, in the case where control is performed on the basis of a fixed threshold value for the powder fraction, it is difficult to prevent the pressure balance in the furnace from being significantly lost. In addition, by focusing on the fact that a variation in the powder ratio of coke to be charged tends to cause the pressure balance in the furnace to be lost, it may be said to be preferable that the control be performed on the basis of a variation in powder fraction, which indicates a variation in the powder ratio of coke, instead of a fixed threshold value for the powder fraction.

An increase in the powder ratio of coke by 0.5 mass % within 4 hours is one example of a preset first threshold value for a variation within a certain length of time. Moreover, decreasing the blast volume blown through a tuyere is one example of adjusting blast volume blown through a tuyere. The blast volume may be decreased in plural steps. In the case where the blast volume is decreased in plural steps, it is sufficient that the total amount of decrease in blast volume within 1 hour be 5% or more. In the case where the total amount of decrease in blast volume within 1 hour is less than 5%, it is not possible to achieve an effect of decreasing the degree of gas flow turbulence in the furnace. On the other hand, in the case where the total amount of decrease in blast volume within 1 hour is excessively large, there may be a variation in the state of blast furnace operation. Therefore, it is preferable that the total amount of decrease in blast volume within 1 hour be 5% or more and 15% or less or more preferably 5% or more and 10% or less.

After the blast volume blown through a tuyere has been decreased by 5% or more, in the case where there is an increase, with no decrease, in the hourly average value of the powder ratio of coke by 0.5 mass % or more within 2 hours, it is preferable that the blast volume blown through a tuyere be further decreased by 5% or more. Consequently, even in the case where there is an additional deterioration in furnace gas permeability due to an additional increase in the amount of coke powder having a particle diameter of 5 mm or less, since it is possible to decrease the degree of gas flow turbulence in the furnace by decreasing the blast volume blown through the tuyere, it is possible to further inhibit the pressure balance in the furnace from being significantly lost.

Generally, to address the issue of a deterioration in furnace gas permeability, the amount of coke charged, which functions as a spacer in the furnace, is increased, or the coke ratio of a raw material is increased by decreasing the amount of iron ore charged in relation to the amount of coke charged. However, in the case where the coke ratio is increased, there is an increase in the amount of $CO_2$ emitted, and there is a decrease in the amount of pig iron produced. In the method for operating a blast furnace according to the present embodiment, the particle size distribution of coke transported to the blast furnace 30 is successively measured, and the blast volume is adjusted in accordance with an index derived from the particle size distribution. In such a manner, by adjusting the blast volume blown through a tuyere without increasing the coke ratio of the raw material to address the issue, it is possible to inhibit blast furnace operation from being unstable due to the pressure balance in the furnace being lost due to a deterioration in gas permeability while inhibiting an increase in the amount of $CO_2$ emitted and a decrease in the amount of pig iron produced.

On the other hand, in the case where there is an increase in the hourly average value of the powder ratio of coke by 1.0 mass % or more within 4 hours, since there is a significant deterioration in furnace gas permeability, it is difficult to address the deterioration by only adjusting the blast volume blown through a tuyere. Therefore, in the case where the amount of increase in the powder ratio of coke is large, it is preferable that not only the blast volume blown through a tuyere but also a coke ratio be adjusted. The term "coke ratio" denotes the amount (kg) of coke used to produce one ton of pig iron and is expressed in units of kg/t-pig.

As described above, in the case where there is an increase in the hourly average value of the powder ratio of coke by 1.0 mass % or more within 4 hours while the blast volume is decreased by 5% or more, it is preferable that the coke ratio of a raw material be increased while the blast volume is decreased. Specifically, the coke ratio is increased by 20 kg/t-pig or more within a range in which a reducing agent ratio (the amount (kg) of a reducing agent used to produce one ton of pig iron) is not more than 600 kg/t-pig. For example, under the condition that pulverized fine coal is blown in in an amount of 50 kg/t-pig to 200 kg/t-pig, the coke ratio is increased to 380 kg/t-pig in the case where the coke ratio is 360 kg/t-pig or less, and the coke ratio is increased to 400 kg/t-pig in the case where the coke ratio is more than 360 kg/t-pig and less than 400 kg/t-pig. In the case where the coke ratio is 400 kg/t-pig or more, the coke ratio is not increased.

In the case where the coke ratio is increased while the blast volume blown through a tuyere is decreased to address the issue of an increase in the powder ratio of coke, one threshold value, that is, an increase in the powder ratio of coke by 0.5 mass % within 4 hours, and another threshold value, that is, an increase in the powder ratio of coke by 1.0 mass % within 4 hours, whose absolute value is larger than that of the former threshold value, are set in advance. Then, in the case where there is an increase in the powder ratio of coke by 0.5 mass % or more and less than 1.0 mass % within 4 hours, the blast volume blown through a tuyere is decreased while the coke ratio is not changed. In the case where there is an increase in the powder ratio of coke by 1.0 mass % or more within 4 hours, the coke ratio is increased while the blast volume is not changed. Consequently, even in the case where there is an increase in the hourly average value of the powder ratio of coke by as much as 1.0 mass % within 4 hours, which may result in a significant deterioration in gas permeability in the furnace, it is possible to inhibit the pressure balance in the furnace from being significantly lost. An increase in the powder ratio of coke by 1.0 mass % within 4 hours is one example of a preset second threshold value for a variation within a certain length of time. Moreover, increasing a coke ratio is one example of adjusting a coke ratio. Although, in the example described above, an example in which the coke ratio is increased while the blast volume blown through a tuyere is decreased to address the issue of an increase in the powder ratio of coke has been described, the disclosed embodiments are not intended to be limited to the example above, and the issue may be addressed by only decreasing the blast volume or by only increasing the coke ratio. That is, in the method for operating a blast furnace according to the present embodiment, at least one of the blast volume and the coke ratio is adjusted in accordance with an index calculated from a particle size distribution. Consequently, since it is possible to decrease the degree of gas flow turbulence in the furnace, it is possible to inhibit the pressure balance in the furnace from being significantly lost, which results in stable blast furnace operation being achieved.

In the case where the total amount of decrease in the blast volume blown through a tuyere is 15% or more or a blast volume ratio is 1.2 or less, it is preferable that the control of the blast volume utilizing the particle size distribution measuring apparatus 10 be stopped. In the case where the total amount of decrease in the blast volume blown through a tuyere is 15% or more or a blast volume ratio is 1.2 or less, there is a high likelihood of the occurrence of an issue other than that of a deterioration in furnace gas permeability due to coke powder having a particle diameter of 5 mm or less. Therefore, there is a risk of a deterioration, rather than an improvement, in furnace state if the control of the blast volume is performed by utilizing the particle size distribution measuring apparatus 10. Therefore, in the case where the total amount of decrease in the blast volume blown through a tuyere is 15% or more or a blast volume ratio is 1.2 or less, it is preferable that the control of the blast volume utilizing the particle size distribution measuring apparatus 10 be stopped. Here, the term "blast volume ratio" denotes a value calculated by using the equation (blast volume ratio)=(blast volume blown through a tuyere) [$Nm^3$/min]/(blast furnace volume) [$m^3$].

In the method in which the blast volume blown through a tuyere is decreased, after a lapse of 4 hours from when the blast volume was decreased, in the case where there is a decrease in the hourly average value of the powder ratio of coke compared with that when the blast volume was decreased, it is preferable that the blast volume blown through a tuyere be reset to the value before it was decreased. In the present embodiment, it is preferable that the blast volume be reset to the original value, for example, by increasing the blast volume blown through a tuyere by 5% in the case where the blast volume blown through a tuyere was decreased by 5%, and by increasing the blast volume blown through a tuyere by 10% in the case where the blast volume blown through a tuyere was decreased by 10% (a decrease by 5% was performed twice).

After a lapse of 4 hours from when the blast volume blown through a tuyere was decreased, gas flow in the furnace is stabilized. Therefore, after a lapse of 4 hours from when the blast volume blown through a tuyere was decreased, in the case where there is no increase in the hourly average value of powder ratio of coke and there is a decrease in the average value of the powder ratio of coke, it is preferable that the blast volume blown through a tuyere be reset to the value before it was decreased. By resetting the blast volume blown through a tuyere to the original value after a lapse of 4 hours from when the blast volume was decreased, it is possible to reset the blast volume blown through a tuyere to the original value while the pressure balance in the furnace is not significantly lost.

In a similar manner, since gas flow in the furnace is stabilized after a lapse of 4 hours from when the coke ratio was increased, the coke ratio may be reset to the value before it was increased after a lapse of 4 hours from when the coke ratio was increased in the case where there is no increase in the hourly average value of the powder ratio of coke compared with that when the coke ratio was increased and there is a decrease in the average value of the powder ratio of coke. By resetting the coke ratio to the original value after a lapse of 4 hours from when the coke ratio was increased in such a manner, it is possible to reset the coke ratio to the original value while the pressure balance in the furnace is not significantly lost.

In the method for operating a blast furnace according to the present embodiment, the powder ratio of coke is used as an index derived from a particle size distribution, the disclosed embodiments are not limited to this example. For example, as an index derived from a particle size distribution, the void fraction of a coke-packed layer (hereinafter, referred to as "void fraction of coke") in a blast furnace may be used. It is possible to calculate the void fraction of coke by using the particle size distribution of the fine particles of coke to be charged into a blast furnace, which is measured by using the particle size distribution measuring apparatus 10, the particle size distribution of the coarse particles of the coke, which is successively measured by using, for example, a laser distance meter, and the model proposed by Sato and Taguchi, which is described in Non Patent Literature 1. According to the above-mentioned model, the void fraction ε is calculated by using mathematical expression (1) below.

[Math. 1]

[Math. 1]

$$\varepsilon = (a \times \log D_p + b) \times \left(1 - c \times I_{sp}^{d}\right) \qquad \text{mathematical expression (1)}$$

In mathematical expression (1) above, a, b, c, and d are parameters and values of which are empirically determined in accordance with the kind of particles. For example, in the case of coke, a=0.153, b=0.418, c=0.01225, and d=0.416. $D_p$ is a harmonic mean diameter, and $I_{sp}$ is defined by mathematical expression (2), mathematical expression (3), and mathematical expression (4) below, and expressed as a numerical value.

[Math. 2]

$$I_{sp} = 100 \times \sqrt{I_p \times I_s} \quad \text{mathematical expression (2)}$$

[Math. 3]

$$I_p = \frac{1}{D_p^2} \times \sum_i w_i (D_i - D_p)^2 \quad \text{mathematical expression (3)}$$

[Math. 4]

$$I_s = D_p^2 \times \sum_i w_i \left(\frac{1}{D_i} - \frac{1}{D_p}\right)^2 \quad \text{mathematical expression (4)}$$

In mathematical expressions (3) and (4), $D_i$ is each particle diameter, and $W_i$ is the mass fraction of particles under the sieve corresponding to each particle diameter. $I_p$, which is defined by mathematical expression (3) and a value expressing the variance of the particle size distribution, and $I_s$, which is defined by mathematical expression (4) and a value expressing the variance of a specific surface area, are both calculated from feature quantities extracted from image data. The void fraction, which is derived in such a manner, may be used as the index derived from a particle size distribution in the method for operating a blast furnace according to the present embodiment.

Figure 4:
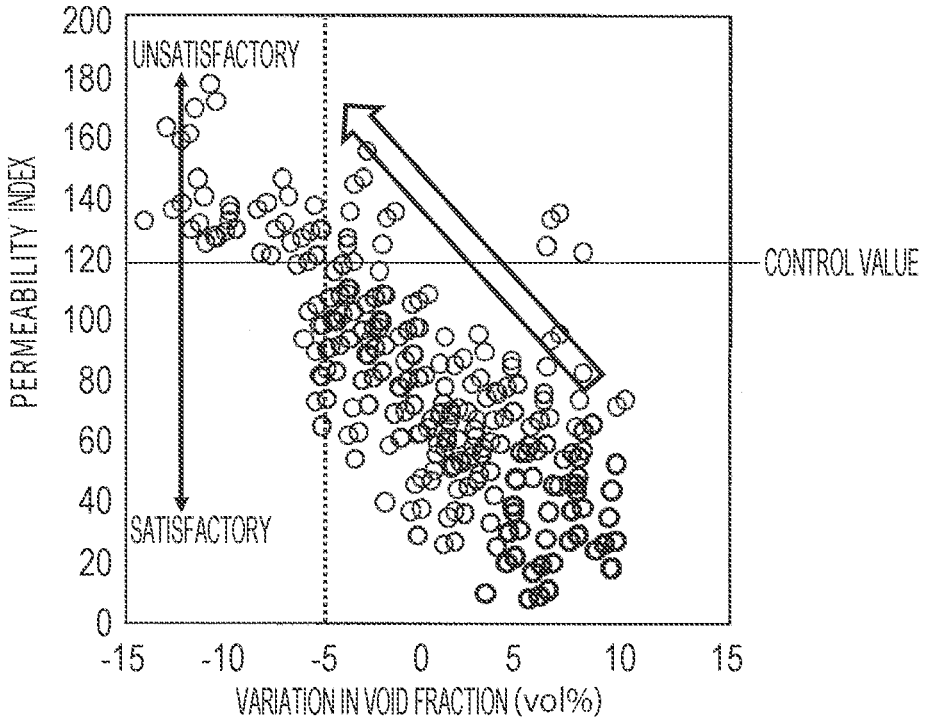
FIG. 4 is a graph illustrating the relationship between a variation in void fraction within 4 hours and a permeability index.

FIG. 4 is a graph illustrating the relationship between a variation in void fraction within 4 hours and a permeability index. In FIG. 4, the horizontal axis represents a variation in void fraction (vol %) within 4 hours, and, for example, the numerical number "−5" on the horizontal axis denotes a case where there is a decrease in void fraction by 5 vol % within 4 hours. That is, a variation in void fraction represented by the horizontal axis is a value calculated by subtracting the void fraction 4 hours earlier from the void fraction at this point of time. The expression "void fraction at this point of time" denotes a value derived by successively measuring the void fraction every time coke is charged into a blast furnace in 1 hour immediately before this point of time, by calculating the average value of the void fraction of every charge, and by calculating the average value of the calculated average values of the void fraction. For example, in the case where coke is charged into a blast furnace 4 times in 1 hour, the void fraction at this point of time may be defined as the average value of the void fractions of coke of the past four charges or the moving average value of the past charges. A variation in void fraction represented by the horizontal axis is obtained by performing such calculation at every 1 hour and by subtracting the void fraction at a time 4 hours before this point of time from the void fraction at this point of time.

In FIG. 4, the vertical axis represents the permeability index at this point of time, and in the case where there is an increase in this permeability index, there is an increased variation in furnace gas permeability in the circumferential direction. The meaning and measuring method of the permeability index are the same as those of the permeability index represented by the vertical axis in FIG. 3.

Each of the plotted data in FIG. 4 is a permeability index which was measured after a blast furnace had been operated without changing conditions for 4 hours from the point of time at which the permeability index was 120 or less. As illustrated in FIG. 4, in the case where there is a variation in void fraction by −5 vol % or less within 4 hours, there is an increase in the probability of the permeability index being more than 120. Therefore, in the method for operating a blast furnace according to the present embodiment utilizing the void fraction as an index, in the case where there is a variation in the hourly average value of the void fraction derived from the coke to be charged into the blast furnace by −5 vol % or less within 4 hours, for example, blast volume blown through a tuyere is decreased by 5% or more. Consequently, even in the case where there is a deterioration in furnace gas permeability due to a decrease in void fraction, since it is possible to decrease the degree of gas flow turbulence in the furnace by decreasing the blast volume blown through the tuyere, it is possible to inhibit the pressure balance in the furnace from being significantly lost. A variation in void fraction by −5 vol % within 4 hours is another example of a preset first threshold value for a variation within a certain length of time. The blast volume blown through a tuyere may be decreased in one step or in plural steps.

It is necessary that a threshold value be adjusted in accordance with the states of raw materials to be charged into a blast furnace, since there is a case where the void fraction is always more than the threshold value depending on raw materials to be charged into a blast furnace. Therefore, in the case where control is performed on the basis of a fixed threshold value for the void fraction, it is difficult to prevent the pressure balance in the furnace from being significantly lost. In addition, by focusing on the fact that a variation in void fraction tends to cause the pressure balance in the furnace to be lost, it may be said to be preferable that the control be performed on the basis of a variation in void fraction instead of a fixed threshold value for the void fraction.

After the blast volume blown through a tuyere has been decreased by 5% or more, in the case where there is a variation, with no increase, in the hourly average value of the void fraction by −5 vol % or less within 2 hours, it is preferable that the blast volume blown through a tuyere be further decreased by 5% or more. Consequently, even in the case where there is an additional deterioration in furnace gas permeability due to an additional decrease in void fraction, since it is possible to decrease the degree of gas flow turbulence in the furnace by additionally decreasing the blast volume blown through the tuyere, it is possible to further inhibit the pressure balance in the furnace from being significantly lost.

On the other hand, in the case where there is a variation in the hourly average value of the void fraction by −10 vol % or less within 4 hours, which results in a significant deterioration in furnace gas permeability, it is difficult to address the deterioration by only adjusting the blast volume blown through a tuyere. Therefore, in the case where the amount of decrease in void fraction is large, it is preferable that not only the blast volume blown through a tuyere but also a coke ratio be adjusted. As described above, in the case where there is a variation in the hourly average value of the void fraction by −10 vol % or less within 4 hours while the blast volume is decreased by 5% or more, it is preferable that the coke ratio of a raw material be increased while the blast volume is decreased.

Specifically, the coke ratio is increased by 20 kg/t-pig or more within a range in which a reducing agent ratio (the amount (kg) of a reducing agent used to produce one ton of pig iron) is not more than 600 kg/t-pig. For example, under the condition that pulverized fine coal is blown in in an amount of 50 kg/t-pig to 200 kg/t-pig, the coke ratio is increased to 380 kg/t-pig in the case where the coke ratio is 360 kg/t-pig or less, and the coke ratio is increased to 400 kg/t-pig in the case where the coke ratio is more than 360 kg/t-pig and less than 400 kg/t-pig. In the case where the coke ratio is 400 kg/t-pig or more, the coke ratio is increased no more.

In the case where the blast volume blown through a tuyere is decreased while the coke ratio is increased to address the issue of a decrease in void fraction, one threshold value, that is, a variation in void fraction by −5 vol % within 4 hours, and another threshold value, that is, a variation in void fraction by −10 vol % within 4 hours, whose absolute value is larger than that of the former threshold value, are set in advance. Then, in the case where there is a variation in void fraction by −5 vol % or less and more than −10 vol % within 4 hours, the blast volume blown through a tuyere is decreased while the coke ratio is not changed. In the case where there is a variation in void fraction by −10 vol % or less within 4 hours, the coke ratio is increased while the blast volume is not decreased. Consequently, even in the case where there is a variation in the hourly average value of the void fraction by −10 vol % or less within 4 hours, which may result in a significant deterioration in furnace gas permeability, it is possible to inhibit the pressure balance in the furnace from being significantly lost. A variation in void fraction by −10 vol % within 4 hours is another example of a preset second threshold value for a variation within a certain length of time. Although, in the example described above, an example in which the blast volume blown through a tuyere is decreased while the coke ratio is increased to address the issue of a decrease in void fraction has been described, the disclosed embodiments are not limited to the example above, and the issue may be addressed by only decreasing the blast volume or by only increasing the coke ratio.

In the example in which the blast volume blown through a tuyere is decreased, after a lapse of 4 hours from when the blast volume was decreased, in the case where there is an increase in the hourly average value of the void fraction compared with that when the blast volume was decreased, it is preferable that the blast volume blown through a tuyere be reset to the value before it was decreased. It is preferable that the blast volume be reset to the original value, for example, by increasing the blast volume blown through a tuyere by 5% in the case where the blast volume blown through a tuyere was decreased by 5%, and by increasing the blast volume blown through a tuyere by 10% in the case where the blast volume blown through a tuyere was decreased by 10% (a decrease by 5% was performed twice).

After a lapse of 4 hours from when the blast volume blown through a tuyere was decreased, gas flow in the furnace is stabilized. Therefore, after a lapse of 4 hours from when the blast volume blown through a tuyere was decreased, in the case where there is no decrease in the hourly average value of the void fraction and there is an increase in the average value of the void fraction, it is preferable that the blast volume blown through a tuyere be reset to the value before it was decreased. By resetting the blast volume blown through a tuyere to the original value after a lapse of 4 hours from when the blast volume was decreased, it is possible to reset the blast volume blown through a tuyere to the original value while the pressure balance in the furnace is not significantly lost.

In a similar manner, since gas flow in the furnace is stabilized after a lapse of 4 hours from when the coke ratio was increased, the coke ratio may be reset to the value before it was increased after a lapse of 4 hours from when the coke ratio was increased in the case where there is no decrease in the hourly average value of the void fraction compared with that when the coke ratio was increased and there is an increase in the average value of the hourly average values of the void fraction. By resetting the coke ratio to the original value after a lapse of 4 hours from when the coke ratio was increased in such a manner, it is possible to reset the coke ratio to the original value while the pressure balance in the furnace is not significantly lost.

As above, as examples of an index derived from a particle size distribution, an example utilizing the powder ratio of coke as the index and an example utilizing a void fraction as the index have been described. In both cases, a variation in the value of the index within a certain length of time is defined as a value calculated by subtracting the value of the index a certain length of time earlier from the value of the index at this point of time. A case of an increase in the powder ratio of coke is not preferable for blast furnace operation when the powder ratio of coke is used as the index, and a case of a decrease in void fraction is not preferable for blast furnace operation when the void fraction is used as the index. Therefore, in the case where the powder ratio of coke is used as the index, it is preferable that the first or second threshold value be positive and that a blast volume or a coke ratio be adjusted when a variation in the powder ratio of coke is equal to or more than the threshold value. On the other hand, in the case where the void fraction is used as the index, it is preferable that the first or second threshold value be negative and that a blast volume or a coke ratio be adjusted when a variation in void fraction is equal to or less than the threshold value.

Example 1

Example 1, in which the method for operating a blast furnace according to the present embodiment was implemented, will be described. In the method for operating a blast furnace of example 1, the powder ratio of coke was used as the index derived from a particle size distribution. While coke which had been sieved by using a sieve having a sieve mesh of 35 mm was transported to the coke storage of a blast furnace by using a conveyer, the powder fraction of the transported coke was measured online by using a particle size distribution measuring apparatus 10. The coke was charged into a blast furnace from the coke storage at a rate of 4 charges/hour. The average value of the powder ratio of coke measured in each of the charges was calculated, and the powder ratio of coke was defined as the average value of the calculated average values of the powder fraction of the four charges. On the basis of this powder ratio of coke, a blast volume blown through a tuyere and a coke ratio were controlled.

Regarding controlling the blast volume blown through a tuyere, the blast volume blown through a tuyere was decreased by 5% in the case where there was an increase in the powder ratio of coke by 0.5 mass % within 4 hours, and the blast volume blown through a tuyere was additionally decreased by 5% in the case where there was an additional increase in the powder ratio of coke by 0.5 mass % or more within 2 hours. Regarding controlling the coke ratio, in the case where there was an increase in the powder ratio of coke by 1.0 mass % or more within 4 hours, the coke ratio was increased to 380 kg/t-pig when the coke ratio was 360 kg/t-pig or less, and the coke ratio was increased to 400 kg/t-pig when the coke ratio was more than 360 kg/t-pig and less than 400 kg/t-pig. When the coke ratio was 400 kg/t-pig or more, the coke ratio was increased no more.

In the example in which the blast volume blown through a tuyere was decreased, after a lapse of 4 hours from when the blast volume was decreased, in the case where there was a decrease in the powder ratio of coke compared with that when the blast volume was decreased, the blast volume blown through a tuyere was reset to the value before it was decreased. Moreover, after a lapse of 4 hours from when the coke ratio was increased, in the case where there was a decrease in the powder ratio of coke compared with that when the coke ratio was increased, the coke ratio was reset to the value before it was increased.

Figure 5:
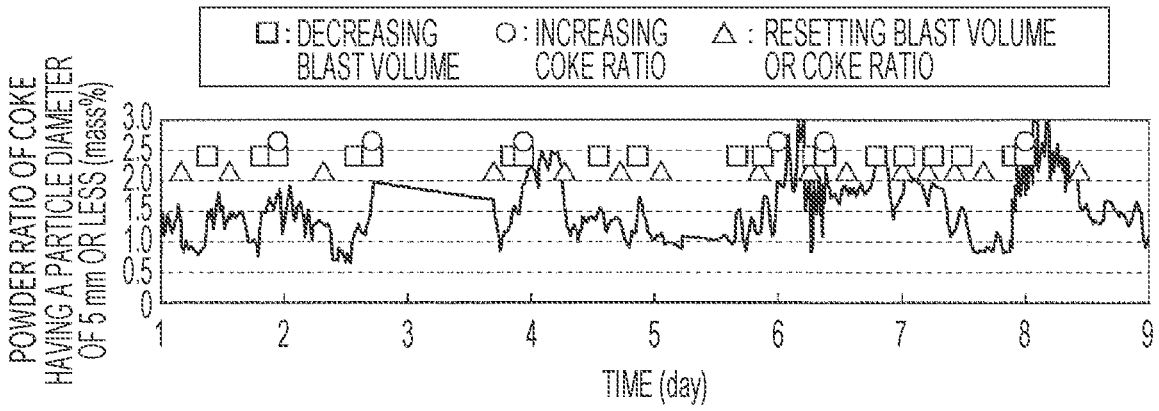
FIG. 5 is a graph illustrating one example of a variation in the powder ratio of coke.

FIG. 5 is a graph illustrating one example of a variation in the powder ratio of coke. In FIG. 5, the horizontal axis represents the time (day), and the vertical axis represents the powder ratio of coke, the powder having a particle diameter of 5 mm or less (mass %). In FIG. 5, the symbol □ denotes a case where the blast volume blown through a tuyere was decreased by 5%, and the symbol ○ denotes a case where the coke ratio was increased. On the other hand, the symbol Δ denotes a case where the blast volume or the coke ratio was reset to the value before it was changed.

Figure 6:
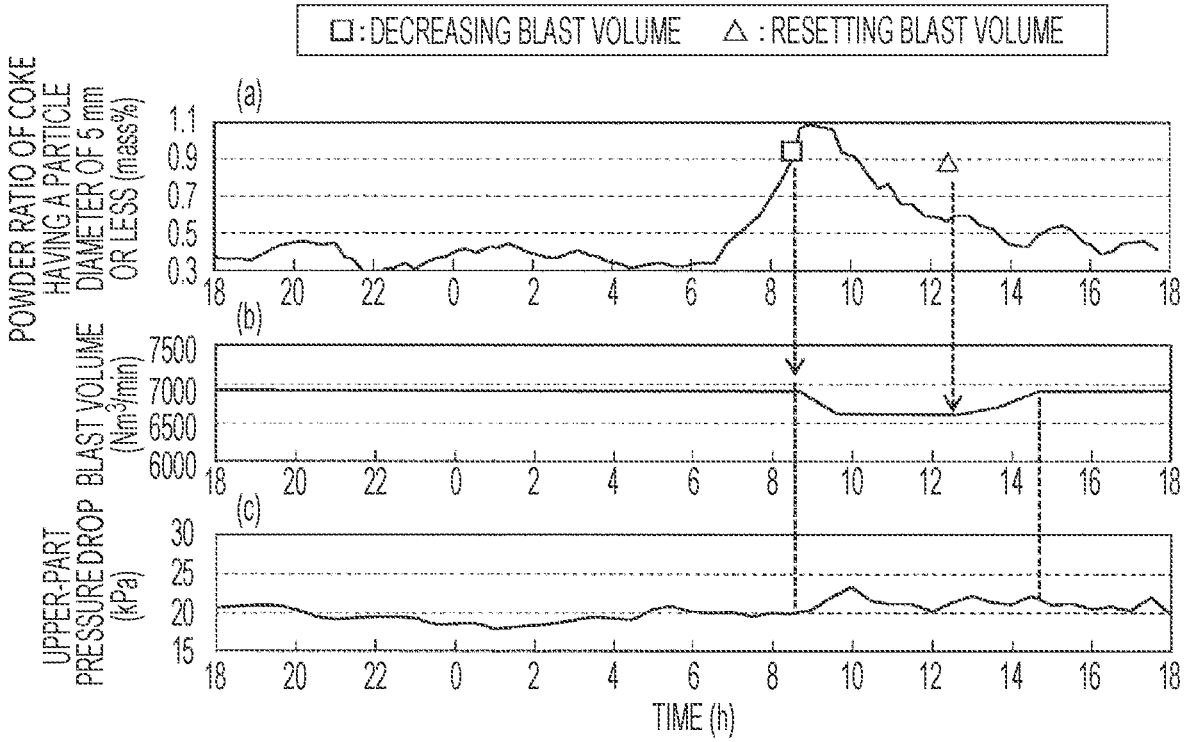
FIG. 6(*a*) is a graph illustrating one example of a variation in the powder ratio of coke, FIG. 6(*b*) is a graph illustrating one example of a variation in blast volume blown through a tuyere, and FIG. 6(*c*) is a graph illustrating one example of a variation in the upper-part pressure drop of a blast furnace.

FIG. 6(*a*) is a graph illustrating one example of a variation in the powder ratio of coke, FIG. 6(*b*) is a graph illustrating one example of a variation in blast volume blown through a tuyere, and FIG. 6(*c*) is a graph illustrating one example of a variation in the upper-part pressure drop of a blast furnace. In FIG. 6, the horizontal axis represents the time (h), the vertical axis of FIG. 6(*a*) represents the powder ratio of coke, the powder having a particle diameter of 5 mm or less (mass %), the vertical axis of FIG. 6(*b*) represents the blast volume ($Nm^3$/min), and the vertical axis of FIG. 6(*c*) represents the upper-part pressure drop (kPa). Here, the term "upper-part pressure drop" denotes the difference (kPa) between a pressure at the furnace top and a pressure measured by using a pressure meter disposed at a position located about 10 m below the stock line of the furnace.

As illustrated in FIG. 6(*a*), since it was detected that the powder ratio of coke, which was measured by using the particle size distribution measuring apparatus 10, started increasing from a time of 6.0 h and that, at a time of 8.5 h, there was an increase in the hourly average value of powder fraction by 0.5% within 4 hours, the blast volume was decreased by 5% (□ in FIG. 6(*a*)). Although it is presumed that there is an increase in upper-part pressure drop due to a deterioration in furnace gas permeability in the case where there is an increase in the hourly average value of the powder ratio of coke having a particle diameter of 5 mm or less by 0.5 mass % within 4 hours, there was no increase in upper-part pressure drop as illustrated in FIG. 6(*c*). From such a result, it was clarified that, even in the case where there is an increase in the hourly average value of the powder ratio of coke by 0.5 mass % within 4 hours, since there is no increase in upper-part pressure drop as a result of the blast volume being decreased by 5%, it is possible to inhibit the pressure balance in the furnace from being significantly lost.

Moreover, after a lapse of 4 hours from when the blast volume blown through a tuyere was decreased by 5%, since there was a decrease in the powder ratio of coke compared with that when the blast volume was decreased, the blast volume blown through a tuyere was increased by 5% so as to be reset to the value before it was changed (Δ in FIG. 6(*a*)). Since the blast volume had been decreased by 5% to address the issue of a deterioration in gas permeability in the furnace due to an increase in the hourly average value of the powder ratio of coke by 0.5 mass % within 4 hours, it was considered that there was a risk of an increase in an upper-part pressure drop index as a result of the blast volume being increased by 5%. However, there was no increase in an upper-part pressure drop index as illustrated in FIG. 6(*c*). From such a result, it was clarified that, since the pressure balance in the furnace is stabilized after the lapse of 4 hours from when the blast volume was decreased, in the case where the blast volume is reset on such an occasion, there is no increase in an upper-part pressure drop index, even though the blast volume blown through a tuyere is reset, it is thereby possible to inhibit the pressure balance in the furnace from being significantly lost.

Figure 7:
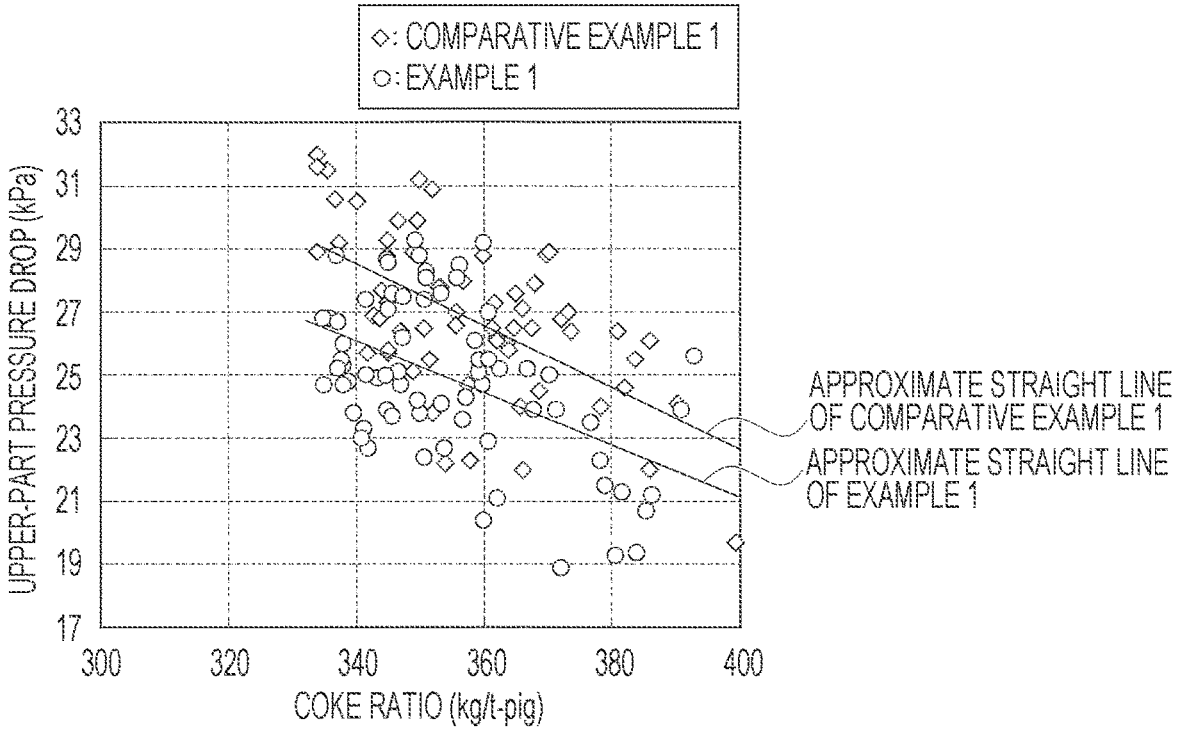
FIG. 7 is a graph illustrating the relationship between a coke ratio and an upper-part pressure drop.

To confirm the effect of the method for operating a blast furnace of example 1, the relationship between the coke ratio and the upper-part pressure drop was investigated in one blast furnace in the case where the control of the blast volume and the coke ratio was not performed for two months (comparative example 1) and in the case where the control of the blast volume and the coke ratio was performed for two months (example 1). FIG. 7 is a graph illustrating the relationship between a coke ratio and an upper-part pressure drop. In FIG. 7, the horizontal axis represents the coke ratio (kg/t-pig), and the vertical axis represents the upper-part pressure drop (kPa). In the period of comparative example 1, the coke had an average strength DI (150/15) of 82.8, an average particle diameter of 42.7 mm, and an average powder fraction of 0.6%. In the period of example 1, the coke had an average strength DI (150/15) of 82.7, an average particle diameter of 42.8 mm, and an average powder fraction of 0.7%. As above, the average properties of the coke were almost the same in the period of comparative example 1 and in the period of example 1.

As illustrated in FIG. 7, the approximate straight line of the plotted data of example 1, which indicates the relationship between the coke ratio and the upper-part pressure drop in the case where the powder ratio of coke was measured and the adjustments of the blast volume and the coke ratio were performed on the basis of the measured powder fraction in accordance with the method for operating a blast furnace according to example 1, was below the approximate straight line of the plotted data of comparative example 1, which indicates the result in the case where the adjustments of the blast volume and the coke ratio were not performed. From this result, it was clarified that it is possible to inhibit an increase in upper-part pressure drop by using the method for operating a blast furnace of example 1. Since a deterioration in gas permeability in a furnace causes an increase in upper-part pressure drop, it was clarified that it is possible to inhibit a deterioration in gas permeability in a furnace by using the method for operating a blast furnace of example 1, and it is thereby possible to achieve the stabilization of blast furnace operation.

Example 2

Hereafter, example 2, in which the method for operating a blast furnace according to the present embodiment was implemented, will be described. In the method for operating a blast furnace of example 2, a void fraction was used as the index derived from a particle size distribution. While coke which had been sieved by using a sieve having a sieve mesh of 35 mm was transported to the coke storage of a blast furnace by using a conveyer, the particle size distribution of the fine particles of the transported coke and the particle size distribution of the coarse particles of the coke are measured online by using the method described in Patent Literature 2 to derive the void fraction of the coke. The coke was charged into a blast furnace from the coke storage at a rate of 4 charges/hour. The average value of the void fraction of coke measured in each of the charges was calculated, and the void fraction of coke was defined as the average value of the calculated average values of the void fraction of the four charges. By using this void fraction of coke, a blast volume blown through a tuyere and a coke ratio were controlled.

Regarding controlling the blast volume blown through a tuyere, the blast volume blown through a tuyere was decreased by 5% in the case where there was a variation in the hourly average value of the void fraction by −5 vol % or less within 4 hours, and the blast volume blown through a tuyere was additionally decreased by 5% in the case where there was an additional variation in the hourly average value of the void fraction by −5 vol % or less within 2 hours. Regarding controlling the coke ratio, in the case where there was a variation in the hourly average value of the void fraction by −10 vol % or less within 4 hours, the coke ratio was increased to 380 kg/t-pig when the coke ratio was 360 kg/t-pig or less, and the coke ratio was increased to 400 kg/t-pig when the coke ratio was more than 360 kg/t-pig and less than 400 kg/t-pig. When the coke ratio was 400 kg/t-pig or more, the coke ratio was increased no more.

In the example in which the blast volume blown through a tuyere was decreased, after a lapse of 4 hours from when the blast volume was decreased, in the case where there was an increase in void fraction compared with that when the blast volume was decreased, the blast volume blown through a tuyere was reset to the value before it was decreased. Moreover, after a lapse of 4 hours from when the coke ratio was increased, in the case where there was an increase in void fraction compared with that when the coke ratio was increased, the coke ratio was reset to the value before it was increased.

To confirm the effect of the method for operating a blast furnace of example 2, the relationship between the coke ratio and the upper-part pressure drop was investigated in one blast furnace in the case where the control of the blast volume and the coke ratio was not performed for two months (comparative example 2) and in the case where the control of the blast volume and the coke ratio was performed for two months (example 2).

Figure 8:
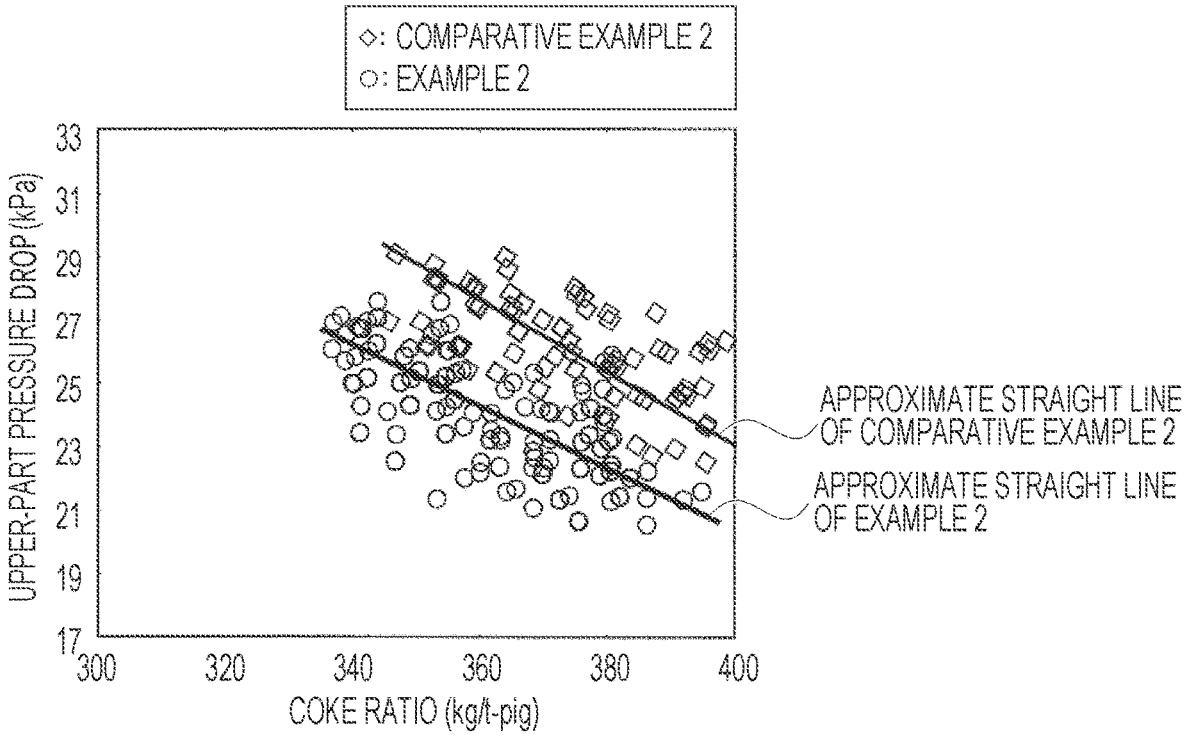
FIG. 8 is a graph illustrating the relationship between a coke ratio and an upper-part pressure drop.

FIG. 8 is a graph illustrating the relationship between a coke ratio and an upper-part pressure drop. In FIG. 8, the horizontal axis represents the coke ratio (kg/t-pig), and the vertical axis represents the upper-part pressure drop (kPa). In the period of comparative example 2, the coke had an average strength DI (150/15) of 83.0, an average particle diameter of 44.0 mm, and an average void fraction of 48.3%. In the period of example 2, the coke had an average strength DI (150/15) of 82.9, an average particle diameter of 43.8 mm, and an average void fraction of 48.2%. As above, the average properties of the coke were almost the same in the period of comparative example 2 and in the period of example 2.

As illustrated in FIG. 8, the approximate straight line of the plotted data of example 2, which indicates the relationship between the coke ratio and the upper-part pressure drop in the case where the void fraction was measured and the adjustments of the blast volume and the coke ratio were performed on the basis of the measured void fraction in accordance with the method for operating a blast furnace according to example 2, was below the approximate straight line of the plotted data of comparative example 2, which indicates the result in the case where the adjustments of the blast volume and the coke ratio were not performed. From this result, it was clarified that it is possible to inhibit an increase in upper-part pressure drop by using the method for operating a blast furnace of example 2. Since a deterioration in gas permeability in a furnace causes an increase in upper-part pressure drop, it was clarified that it is possible to inhibit a deterioration in gas permeability in a furnace by using the method for operating a blast furnace of example 2, and it is thereby possible to achieve the stabilization of blast furnace operation.

The invention claimed is:

1. A method for operating a blast furnace, the method comprising:

transporting coke to the blast furnace;

blowing air through a tuyere disposed in a lower part of the blast furnace;

successively measuring a particle size distribution of the coke transported to the blast furnace;

determining a powder ratio of the coke from the particle size distribution, the powder ratio of the coke being a ratio of a mass of coke powder in the coke having a particle diameter of 5 mm or less to a total mass of the coke;

determining whether an actual variation in the powder ratio within a length of time is equal to or more than a first threshold value and less than a second threshold value;

determining whether the actual variation in the powder ratio within the length of time is equal to or more than the second threshold value, wherein:

the first threshold value is a first predetermined variation in the powder ratio within the length of time that is set in advance, and the second threshold value is a second predetermined variation in the powder ratio within the length of time that is set in advance, the second threshold value having an absolute value that is more than an absolute value of the first threshold value;

decreasing a blast volume of the air blown through the tuyere without changing the coke ratio, the coke ratio being a weight of coke used to produce one ton of pig iron, when determining that the actual variation in the powder ratio within the length of time is equal to or more than the first threshold value and less than the second threshold value; and increasing the coke ratio based on the powder ratio when determining that the actual variation in the powder ratio within the length of time is equal to or more than the second threshold value.

2. A method for operating a blast furnace, the method comprising:

transporting coke to the blast furnace;

blowing air through a tuyere disposed in a lower part of the blast furnace;

successively measuring a particle size distribution of the coke transported to the blast furnace;

determining a void fraction of a coke-packed layer in the blast furnace from the particle size distribution;

decreasing a blast volume of the air blown through the tuyere when an actual variation in the void fraction within a length of time is equal to or less than a first threshold value and more than a second threshold value, wherein:

the first threshold value is a first predetermined variation in the void fraction within the length of time that is set in advance, and the second threshold value is a second predetermined variation in the void fraction within the length of time that is set is advance, the second threshold value having an absolute value that is more than an absolute value of the first threshold value; and increasing the coke ratio based on the void fraction, the coke ratio being a weight of coke used to produce one ton of pig iron, when the actual variation in the void fraction within the length of time is equal to or less than the second threshold value.

* * * * *